United States Patent [19]

Schedele et al.

[11] Patent Number: 4,577,173

[45] Date of Patent: Mar. 18, 1986

[54] ELECTROMAGNETIC RELAY AND METHOD FOR MANUFACTURING SUCH RELAY

[75] Inventors: Helmut Schedele, Diessen; Josef Schweiger; Heinz Stadler, both of Munich, all of Fed. Rep. of Germany

[73] Assignee: Siemens Aktiengesellschaft, Berlin & Munich, Fed. Rep. of Germany

[21] Appl. No.: 659,894

[22] Filed: Oct. 11, 1984

[30] Foreign Application Priority Data

Oct. 20, 1983 [DE] Fed. Rep. of Germany ..... 3338208

[51] Int. Cl.[4] ..... H01H 51/22

[52] U.S. Cl. ..... 335/80; 335/81; 29/602 R

[58] Field of Search ..... 335/78, 80, 81, 229, 335/230, 235; 29/602

[56] References Cited

U.S. PATENT DOCUMENTS 4,215,329 7/1980 Kobler ..... 335/78

4,311,976 1/1982 Sauer et al. ..... 335/78

4,403,203 9/1983 Schedele ..... 335/81 X

*Primary Examiner*—George Harris

*Attorney, Agent, or Firm*—Hill, Van Santen, Steadman & Simpson

[57] ABSTRACT

A relay having a coil body 1 with a tongue-shaped armature mounted on the inside of the coil body and the armature is secured at one end 6*a* to a first coil flange 4 and its free end moveable between two pole plates 8 which are in the vicinity of the second coil flange 5. At the end where the armature 6 is fastened the coil flange 4 comprises a rim bead which together with the retaining webs 21 of the armature 6 form a planar seating surface for a sealing film 12 and at the other end of the coil flange 5 the two pole plates 8 together with spacing members of the coil body form a planar seating surface for a sealing film 9 and a good seal of the relay is obtained due to such simple structure while maintaining good magnetic coupling.

15 Claims, 11 Drawing Figures

ELECTROMAGNETIC RELAY AND METHOD FOR MANUFACTURING SUCH RELAY

BACKGROUND OF THE INVENTION

1. Field of the Invention

This invention relates in general to an electromagnetic relay having a tongue-shaped armature which is mounted in an axial through-opening of a coil body with the armature fastened at a first end by a first coil flange and with its free end moveable between two contacts between two pole plates in the region of a second coil flange such that a flux transfer plate lies flat against the end face of the first coil flange and is formed at the fastening end of the armature and also at least one section of the pole plates lie flat against the end face of the second coil flange and presses against two positioning members that are mounted in extensions of the narrower sides of the armature and wherein sealing films are mounted at the end faces of both the first and the second coil flanges so as to provide insulation and sealing. The method of manufacturing and making such relay is also disclosed.

2. Description of the Prior Art

Relays are disclosed in German DE-AS No. 27 23 220 and the equivalent U.S. Pat. No. 4,215,329 assigned to the assignee of the present application and the disclosure therein is hereby incorporated by reference in the present application. The design of this relay is such that a good magnetic coupling to the end faces of the coil body is accomplished and the coupling of the pole plates to a flat permanent magnet at the one end face and coupling of the flux transfer plate to a ferromagnetic housing cap at the other end face occurs. This construction also makes it possible to substantially close off the contact space with a sealing film at both end faces so that fluid casting compound cannot penetrate into the inside of the coil body when the relay is incapsulated. The application of the sealing film is still relatively complicated in the prior art structures since there are differences in the levels of the end faces between the coil body surface and the pole plates and the sealing film must be applied in a U-shaped form around the coil body flange because of the pole plates which have their terminal pins that extend about pass the outsides of the respective coil flange and also because of the corresponding flux transfer plate of the armature.

SUMMARY OF THE INVENTION

It is an object of the present invention to provide a relay of a type somewhat similar to that disclosed in U.S. Pat. No. 4,215,329 which can be fabricated in a simpler manner due to the simpler design of the pieces from which the relay is constructed and to improve and allow preliminary sealing with sealing film at both end faces of the coil body and which also assures good closure of the permanent magnetic circuit as well as the exiting flux circuit with the simplest possible structure.

The object of the present invention is accomplished in that a bead rim surrounds the coil body opening at the side coil flange and the opening is penetrated only at two opposite sides by retaining webs of the armature which correspond to the height of the bead and the spacing members at the second coil flange project over the end face of the coil flange with the height corresponding to the thickness of the pole plates and the pole plates are positioned between the spacing members and at respective retaining tabs which are provided at the rim of the coil flange.

A planar seating surface for a sealing film is formed at both end faces of the coil body in the design of the invention of the pole plates and spacer members at one coil flange and of the armature retaining webs and rim bead at the other coil flange so that the film only need be designed as a flat sheet and can thus be easily applied and a good seal is assured. A good magnetic coupling through the thin sealing film results due to the matching of projecting parts of the coil body and supported metal parts, in other words, the pole plates at one end and a flux transfer plate at the other end, so that good magnetic coupling for a flat four-pole permanent magnet to the pole plates is accomplished and good coupling for a frame-shaped yoke or for a ferromagnetic cap is accomplished at the flux transfer plate.

In a further development of the relay of the invention, the gaps formed between the pole plates and the spacer members are formed as a labyrinth. This assures that the resin which is used for encapsulating penetrates between the sealing film and the coil body when encapsulated and the relay provides long paths up to the contact space so that the resin will stop before entering between the contact points. The pole plates are designed so that they extend inwardly toward the armature in the region between the spacer members. A sufficient space between the sealing film and the switching location is thus formed and an expansion of the capillary gap between the pole plates and the sealing film results in the direction toward the contact space whereby the casting resin should it penetrate to this extent is stopped. The pole plates are symmetrically designed relative to the coil axis ignoring the terminal pins. It is thus possible to produce respectively only one form of pole plate with terminal pins attached to both sides and to optionally selectively cut-off one or the other of the respective terminal pins before manufacturing.

An additional development provides that the armature is freely cut relative to the film at its fastening end where it only comprises two tabs which lie flush in the rim bead of the coil body. As a result, the mobility of the armature is not restricted during switching due to a glued on sealing film and the casting compound is thereby prevented flowing and affecting the spring constant of the armature (capillary barrier). A good seal is achieved due to the tabs in the rim bead.

In a further development, the relay comprises a polarized relay with a flat four-pole permanent magnet mounted on the pole plates whereby a frame-shaped yoke surrounds the entire relay. This yoke can consist of two identical sheet planar members which are rotated 180° relative to each other and overlap one another in the winding region. It can also be designed as a one piece frame which is deformed in the region of the coil winding so as to provide allowable tolerances. The relay including the yoke is encapsulated in a casting compound on all sides of the encapsulated relay and covers all up to the extent except the extending terminal pins as well as the spacing tabs which extend on all sides. These tabs serve the purpose for guaranteeing a uniform enveloping with a casting compound during the encapsulating process. On the side of the relay which is to be mounted on printed circuit boards, these tabs also provide spacing from the printed circuit boards upon which the relays are to be mounted.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
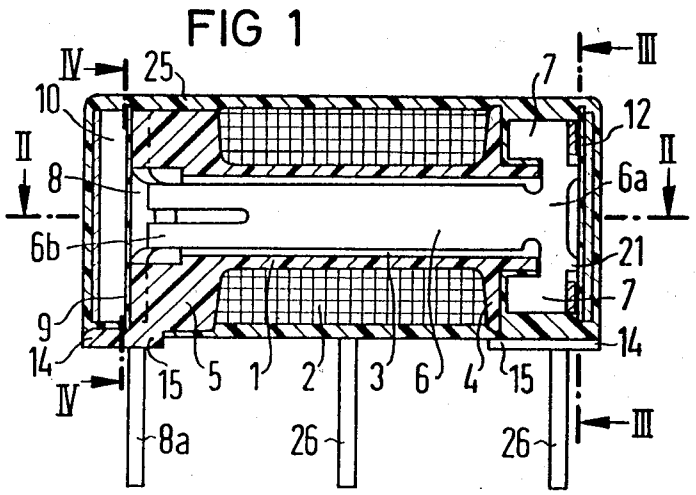
FIG. 1 is a sectional view illustrating the relay of the invention.
Figure 2:
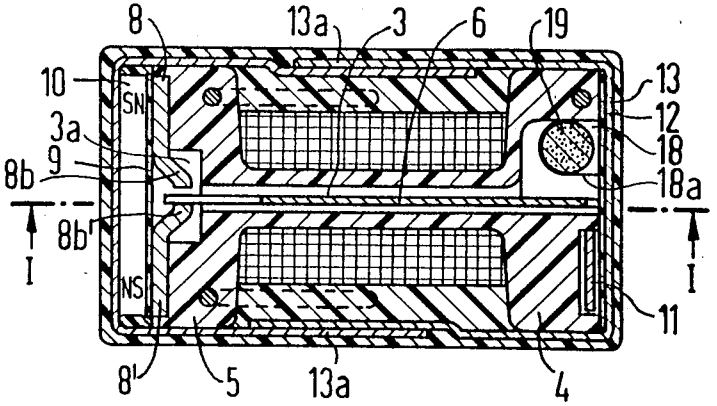
FIG. 2 is a sectional view taken on line II—II of FIG. 1.
Figure 3:
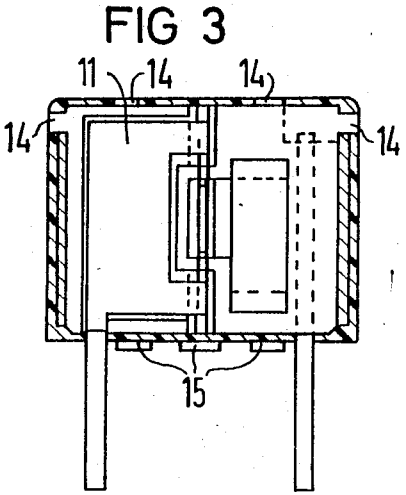
FIG. 3 is a sectional view taken on line III—III shown in FIG. 1.
Figure 4:
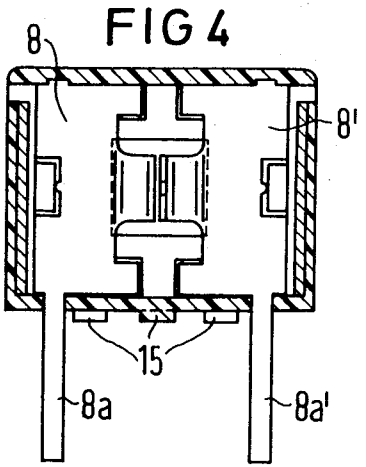
FIG. 4 is a sectional view taken on line IV—IV illustrated in FIG. 1.
Figure 5:
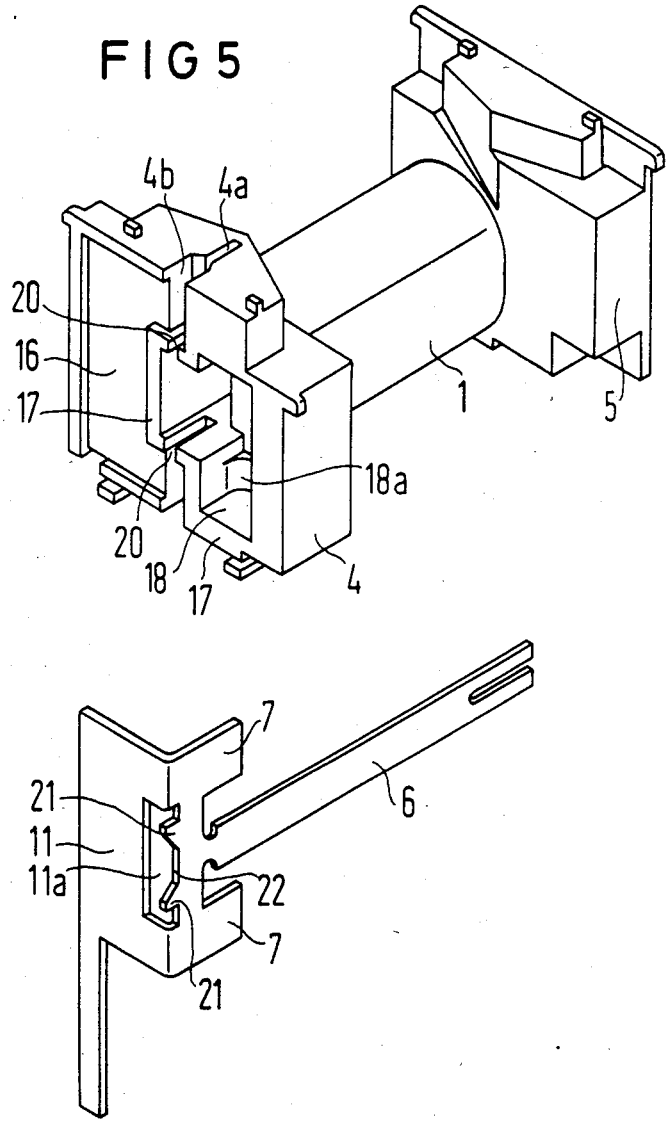
FIG. 5 is an exploded view illustrating the coil body of the armature and an armature.

FIGS. 1 through 6 illustrate the preferred embodiment of the invention which comprises a coil body 1 as shown in perspective view in FIG. 5 which has a central axial cavity 3 and end coil flanges 4 and 5. A winding 2 is wound about the coil body 1. A tongue-shaped armature 6 illustrated for example, in FIG. 5 has an attaching end 6*a* which is secured in the region of coil flange 4 with lateral tabs 7 and a free end 6*b* which is moveable between two pole plates 8 and 8' which are mounted in the vicinity of the coil flange 5. The two pole plates 8 and 8' are essentially flat against the end face of the coil body 1 and—with a sealing film 9 being interposed—form a seating surface for a flat four-pole permanent magnet 10. Terminal pins 8*a* and 8*a'* are formed on the pole plates 8 and 8' respectively and contacts 8*b*, 8*b'* are formed on the pole plates 8 and 8' and extend inwardly into the coil body 1 as illustrated in FIG. 2 and form contact surfaces as well as pole surfaces for the armature end 6*b*. The bending in of the pole plates 8 and 8' causes the working air gaps to be displaced somewhat from the permanent magnet 10 so that the permanent magnet poles are separated better from one another. Due to the extension the path of the working air gaps or respectively the contact locations from the permanent magnet 10 are inhibited. By sealing film 9 sparks are inhibited from occurring when switching occurs and the tolerances of the armature as far as the length of the armature are reduced. The preventing of sparking prevents damaging to the insulating film. On the contact members 8*b* and 8*b'* the pole plates 8 and 8' extend without touching into the coil body opening 3*a* and thus no capillary gaps can form and thus resin which is used for encapsulation will not penetrate to the contact surfaces.

As an extension of the coil flange 4, the armature 6 forms a flux transfer plate 11 which rests flat against the end face of the coil flange 4. A sealing film 12 is placed over the flux guidance plate 11 and the film 12 similar to the film 9 may be designed as a bonding sheet and for example can be fastened to the end face of the coil body using a warm die which heats the film. A frame-shaped yoke 13 consisting of two identical yoke shackles 13*a* rotated by a 180° relative to each other is placed around the overall relay thus formed and is coupled to the permanent magnet 10 at one end face as well as to the flux guidance plate 11 at the other end face. The ends of the two yoke shackles 13*a* overlap in the region of the coil winding 2 so that they can be welded together in this region.

The relay thus formed is encapsulated in casting compound 25 and for this purpose the completely assembled relay including the permanent magnet and the yoke are respectively placed in a casting form in which the casting resin compound is then poured. So as to properly position the relay within the casting compound the coil body has spacing knobs 14 which project in all directions. In the region of the connection side which is connected to a printed circuit board the spacing knobs 14 also merge into spacing tabs 15 which are not completely embedded in the casting compound during encapsulation and serve to assure a space interval for withdrawing vapor from solder when soldering the relay to printing circuit board.

FIG. 5 illustrates the coil body in a perspective view and the coil flange 4 together with the armature 6 are clearly illustrated. The armature is mounted in grooves 4*a* of the coil body flange 4 and the attaching tab 7, are for example, attached by glue. The flux transfer plate 11 which is attached to the armature lies in an end depression 16 of the coil body flange which has a depth somewhat greater than the thickness of the flux transfer plate 11. A bead 17 is formed on the coil flange around the inside space 3 of the coil body. The bead lies in a recess 11*a* of the flux transfer plate on one side and continues to the other side of the opening 3 of the coil body and encloses a getter space 18 which lies in the same plane and which receives a disc-shaped getter tablet 19. The getter space 18 comprises a retaining web 18*a* which at the top and bottom are matched to the contour of the disc-shaped getter 19. The getter 19 has its limits fixed and its central portion is exposed so that the air from the inside space of the coil which enters the getter space 19 can cover the surface without restriction.

Two tabs 21 which are formed as continuations of the armature limit a cut-free section 22 of the armature and lie in two recesses 20 of the bead 17. The free movement of the armature 6 is assured by the tabs, even after the encapsulation and the application of the sealing film 12 and the end faces of the tabs 21 terminate flat with the surface of the bead 17 so that bead 17 together with the tabs 21 form a planar surface for supporting the sealing film 12 as illustrated in FIGS. 1 and 2. Thus, the sealing film can be placed on the end face of the coil body flange as a simple LAMINA and can be fastened with simple dies for example, by means of deformation of a film layer. During casting the casting resin will penetrate into the end depression 16 and into expand chambers 4*b*. The armature is thus additionally held by the resin both in the region of its flux transfer plate as well as in the region of the lateral tabs 7.

Figure 6:
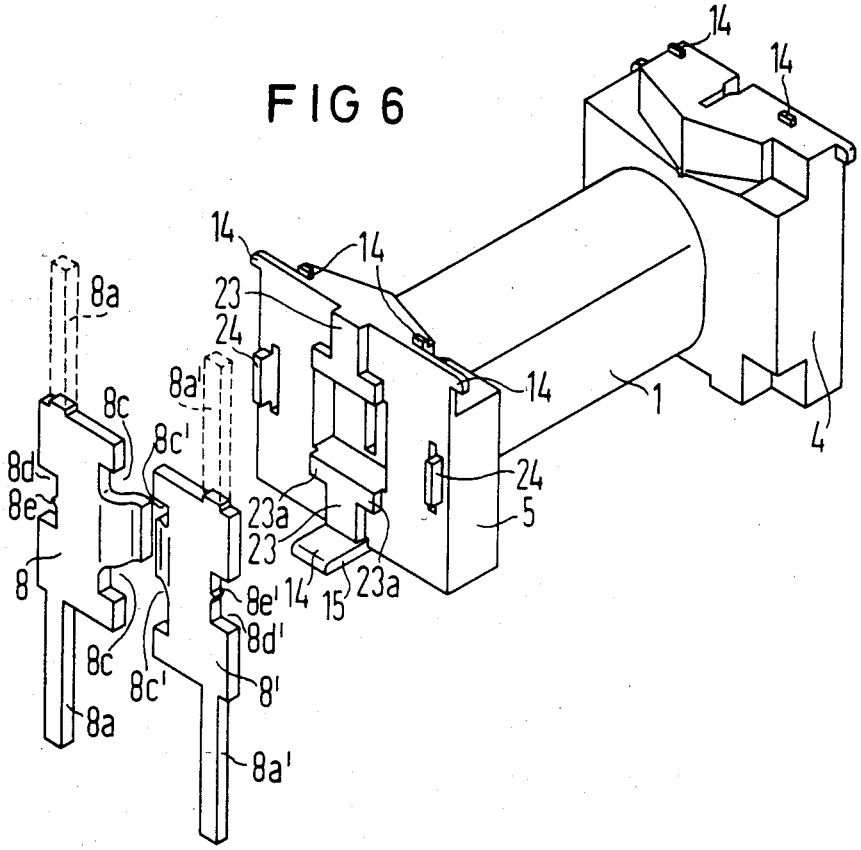
FIG. 6 is an exploded view illustrating the coil body with pole plates which are to be inserted shown in perspective view.

FIG. 6 comprises a perspective view of the other side of the coil body 1 with the coil flange 5 on which the pole plates 8 and 8', respectively are mounted. The coil body flange 5 thereby comprises mutually opposing T-shaped spacing members 23 against which the pole plates 8 and 8' respectively, laterally press and the contact spacing or the working air gap between both pole plates is thus defined. The cross pieces 23*a* of the spacing pieces 23 engage with the cutouts 8*c* or 8*c'* of the pole plates 8 and 8' respectively, so that the gap formed between the two parts produces a labyrinth. The flow of casting compound during encapsulation of the coil body is thus impeded by this labyrinth.

Retaining tabs against which the pole plates 8 and 8' are supported in cutouts 8*d* and 8*d'* respectively, are formed in the edge regions of the coil flange 5. This support provides that the pole plates 8 and 8' are pressed against the spacing members 23 and the ribs 8*e* and 8*e'* respectively provide for tolerance compensation. The height of the spacing members 23 corresponds to the thickness of the pole plates 8 and 8' respectively, and the height of the retaining tabs 24 is also equal to this thickness. A planar seating surface for the sealing film 9 which surrounds the coil body opening also occurs in the region of the coil flange 5.

As illustrated in FIG. 6 the two pole plates 8 and 8' can be designed to be completely identical. Thus, each pole plate 8 can be formed with two terminal pins 8*a* and 8*a'*, respectively, and subsequently one or the other of the terminal pins 8*a* or 8*a'* can be cut from the strip. The two identically designed pole plates are then rotated by 180° relative to each other. The unused terminal pins are illustrated in dashed lines in FIG. 6 because these have been cutoff in the particular example.

Figure 11:
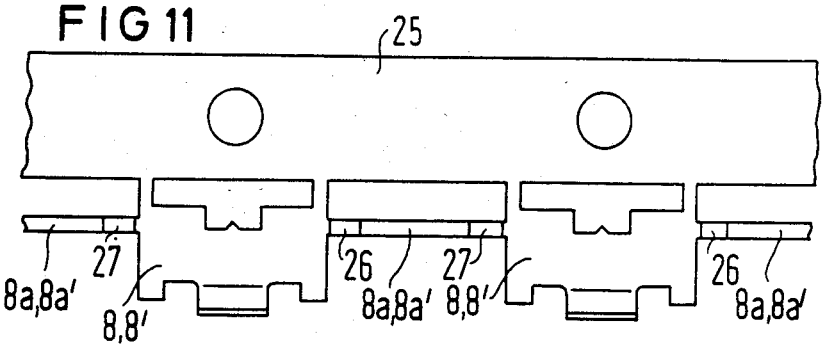
FIG. 11 illustrates the manner of manufacturing the pole plates of the relay from a sheet metal strip.

It is also expedient as shown in FIG. 11 to form the individual identical pole plates 8 and 8' respectively, during one stamping and shaping with one respective intervening terminal pin 8*a* or respectively 8*a'* from a sheet of metal strip material 25. Upon separating the members, the strip is then either cut at the parting locations 26 in order to obtain pole plates 8 having terminal pins 8*a* or, alternatively, the strip is cut at the parting locations 27 so as to obtain pole plates 8' which have terminal pins 8*a'*.

Figure 7:
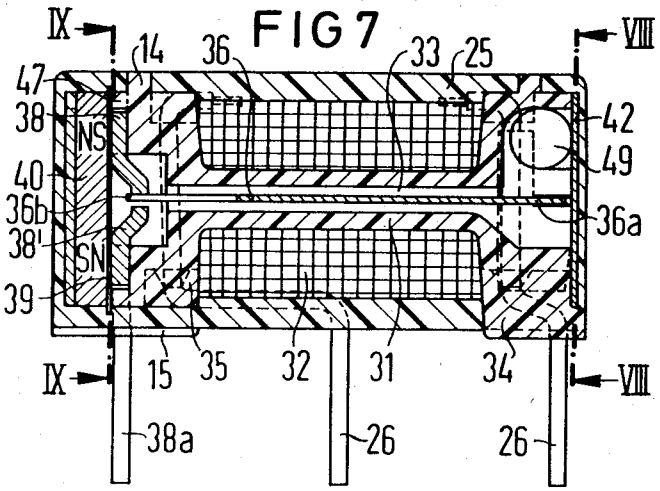
FIG. 7 is a sectional view illustrating a modification of the invention.
Figure 10:
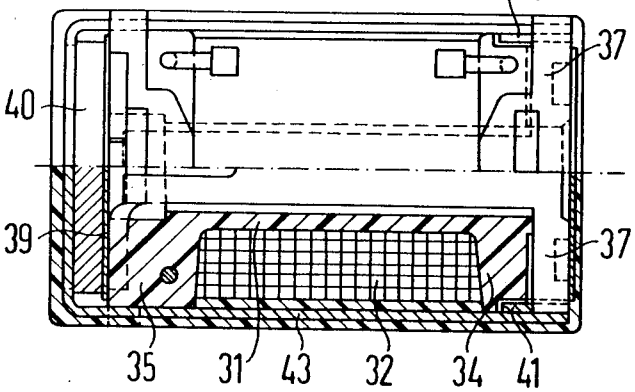
FIG. 10 is a sectional view of the invention.
Figure 8:
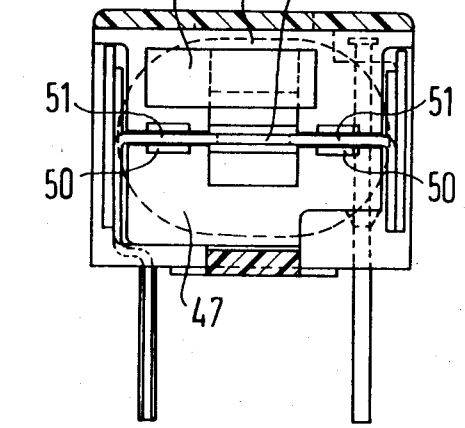
FIG. 8 is a sectional view taken on line VIII—VIII shown in FIG. 7.
Figure 9:
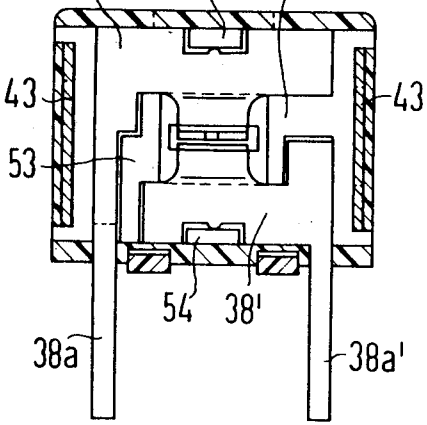
FIG. 9 is a sectional view taken on line IX—IX shown in FIG. 9.

FIGS. 7 through 10 illustrate a modification of the invention wherein the axis of the armature has been rotated relative to the embodiment illustrated in FIGS. 1 through 6 and wherein plane of the armature as, for example, in FIG. 7 lies in the horizontal plane whereas in FIG. 1 it lies in the vertical plane. The relay of FIGS. 7 through 10 is similar to the relay of FIGS. 1 through 6, for example, a coil body 31 has a winding 32 and an inside central opening 33 and end flanges 34 and 35. The armature 36 is mounted in the inside central opening 33 and the armature 36 is attached to the coil flange 34 at one end by fastening tabs 37 and has its free end which is moveable between the two pole plates 38 and 38'.

A sealing film 39 lies adjacent on the pole plates 38 and 38' and a four-pole permanent magnet 40 is mounted thereon. At the opposite sides, the armature forms two laterally applied flux transfer plates 41. The end face is terminated with a sealing film 42 and a yoke 43 is provided for closing the magnetic circuits. In this case the yoke is designed as a U-shaped stirrup with central parts which press against the permanent magnet 40 and has two ends which press against the flux transfer plates 41.

A bead 47 of generally oval shape is provided at the end face of the coil flange 34 and the bead encloses the body coil opening 33 including a getter space 48 into which a getter 49 can be mounted and also comprises two recesses 50 in which retaining webs 51 for the armature are provided. These retaining webs terminate flush at the end face with the surface bead 47 so that a planar seating surface for the sealing film 42 is formed.

At the other end of coil flange 35 the pole plates 38 and 38' are adapted to the orientation of the armature and these pole plates 38 and 38' respectively press against spacing pieces 53 and are supported against upper and lower edges of the coil flange 35 at retaining tabs 54.

The remaining design corresponds to that illustrated in FIGS. 1 through 6 and the height of the spacing members 53 and of the retaining tabs 54 correspond to the thickness of the pole plates 38 and 38', respectively, so that a planar seating surface for the sealing film 39 is formed. The relay illustrated in FIGS. 7 through 10 is also encapsulated in resin as is the embodiment illustrated in FIGS. 1 through 6.

Although the invention has been described with respect of preferred embodiments, it is not to be so limited as changes and modifications can be made which are within the full intended scope of the invention as defined by the appended claims.

We claim as our invention:

1. An electromagnetic relay comprising a coil body, a tongue-shaped armature mounted in an axially through opening of said coil body, said armature having a fastening end secured in the region of a first coil flange to said coil body and having its free end switchable between two pole plates in the region of a second coil flange of said coil body, a flux transfer plate mounted against said first coil flange at the fastening end of said armature, whereby said pole plates have at least one section lying flat against the end face of said second coil flange and rest against two spacing members of said coil flange which are formed as extensions of the narrow sides of said armature, a respective sealing film at the end faces of both said first and second coil flanges, a rim bead (17, 47) formed on said first coil flange (4, 34) which surrounds the coil body opening (3, 33), said rim bead penetrated by two retaining webs (21, 51) of the armature (6, 36) which correspond to the height of the bead (17, 47) which penetrate at only two opposite sides thereof, the spacing members (23, 53) of said second coil flange (5, 35) project over the end face of said second coil flange (5, 35) with a height corresponding to the thickness of said pole plates (8, 8', 38, 38'), and said pole plates (8, 8', 38, 38') positioned between said spacing members (23, 53) and at retaining tabs (24, 54) provided at the edge of said coil flange (5, 35).

2. An electromagnetic relay according to claim 1, wherein the gaps formed between said pole plates (8, 8', 38, 38') and said spacing members (23, 53) are formed like a labyrinth.

3. An electromagnetic relay according to claim 1 or 2, wherein said spacing members (23, 53) are T-shaped.

4. An electromagnetic relay according to claim 1, wherein said pole plates (8, 8', 38, 38') are bent inwardly toward the armature in the region between the spacing members (23, 53) and project contact-free into the coil body opening (3*a*).

5. An electromagnetic relay according to claim 1, wherein said pole plates (8, 8') except for the terminal pins (8*a*, 8*a'*) are symmetrical relative to the coil axis.

6. An electromagnetic relay according to claim 1, wherein the armature (6, 36) is free at its fastening end (6*a*, 36*a*) of the sealing film (12, 42) and maintained by tabs (21) or, respectively, webs (51) lying flush in the rim bead (17, 47).

7. An electromagnetic relay according to claim 1, wherein said armature (6, 36) has lateral tabs (7) at its fastening end (6*a*), said lateral tabs being secured in grooves (4*a*) of said coil body and being additionally fixed by means of casting resin in expanded chambers (4*b*) of the coil body (1).

8. An electromagnetic relay according to claim 1, wherein a getter space (18) which communicates with the inside space (3) of the coil body is formed in a coil flange (4), said getter space comprising retaining webs (18*a*) matched to the contours of a disc-shaped getter (19) such that said getter (19) is fixed at its ends and is exposed in its central region.

9. An electromagnetic relay according to claim 1, wherein a flat, four-pole permanent magnet (10, 40) is arranged on the pole plates (8, 8′, 38, 38′) and a frame-shaped or, respectively, stirrup-shaped yoke (13, 43) engages the relay.

10. An electromagnetic relay according to claim 9, wherein said yoke (13) consists of two identical sheet members (13*a*) rotated by 180° relative to one another and overlapping one another in the winding region.

11. An electromagnetic relay according to claim 9, wherein said yoke is designed as a single-piece frame which is deformed in the region of the coil winding to compensate for tolerance variations.

12. An electromagnetic relay according to claim 1 which is surrounded on all sides by a casting compound (25) which is only penetrated by the terminal pins (8*a*, 8*a*′, 38, 38′, 26) as well as by spacing tabs (14) of the coil body (1, 31) which are provided on every outside surface.

13. A method for manufacturing a relay having two pole plates (8, 8′) which are identical which are formed by cutting and bending to form terminal lugs (8*a*, 8*a*′) on two opposite sides, cutting off one of the terminal lugs (8*a*, 8*a*′) of the strip depending upon the intended mounting position and mounting the two pole plates (8, 8′) onto a second coil body flange (5) rotated by 180° degrees relative to one another.

14. A method according to claim 13, comprising cutting the pole plates (8, 8′) from a sheet of metal strip (25) so they are interconnected via a terminal pin (8*a*, 8*a*′), and cutting the pole plates for different assembly sides to form the terminal pins (8*a*, 8*a*′).

15. The method according to claim 13 or 14, including applying a bonding sheet (9, 12, 39, 42) to both end faces with heated dies after the coil body (1, 31) has been equipped with the pole plates (8, 8′, 38, 38′) and with the armature (6, 36), then mounting the permanent magnet (10, 40) and the yoke (13, 43) encapsulating the relay.

* * * * *